US005950809A

United States Patent [19]

Andre

[11] Patent Number: 5,950,809

[45] Date of Patent: Sep. 14, 1999

[54] KEYBOARD WITH MULTIFUNCTION KEYS AND APPARATUS INCLUDING SUCH A KEYBOARD

[75] Inventor: Jean-Marie Andre, Le Mans, France

[73] Assignee: U.S. Philips Corporation, New York, N.Y.

[21] Appl. No.: 09/011,727

[22] PCT Filed: Jun. 23, 1997

[86] PCT No.: PCT/IB97/00765

§ 371 Date: Feb. 18, 1998

§ 102(e) Date: Feb. 18, 1998

[87] PCT Pub. No.: WO98/01876

PCT Pub. Date: Jan. 15, 1998

[30] Foreign Application Priority Data

Jul. 3, 1996 [FR] France ..... 96 08285

[51] Int. Cl.[6] ..... H01H 9/16; H01H 9/18

[52] U.S. Cl. ..... 200/314; 200/311

[58] Field of Search ..... 200/5 R, 5 A, 200/308–314; 340/815.45, 815.47, 815.48, 815.53, 815.55, 815.56, 815.65; 341/20–23; 302/24; 379/422, 433

[56] References Cited

U.S. PATENT DOCUMENTS

| | | | |
|---|---|---|---|
| 4,131,777 | 12/1978 | Bailey et al. | 200/311 |
| 4,609,792 | 9/1986 | Levasseur | 200/5 A |
| 5,164,723 | 11/1992 | Nebenzahl | 341/23 |
| 5,408,060 | 4/1995 | Muurinen | 200/314 |
| 5,570,114 | 10/1996 | Fowler | 345/173 |
| 5,642,929 | 7/1997 | Ushimaru | 362/85 |

OTHER PUBLICATIONS

"IBM Technical Disclosure Bulletin" vol. 27, No. 11, pp. 6604 and 6605., 1985.

*Primary Examiner*—Michael A. Friedhofer

[57] ABSTRACT

An illuminated keyboard with keys capable of selectively passing through polarized light of different polarization directions. Keys are provided with two different labels. In a first mode a first label associated with a key is selected, and in a second mode a second label associated with the same key is selected. A first polarizing filter is provided, which filter is associated with the first label, for passing through the first label of polarized light emerging from a first source of plane-polarized light, and to filter polarized light emerging from a second source of plane-polarized light, the polarization directions of the two sources being perpendicular to each other. Similarly, a second polarizing filter is provided which is associated with the second label. The selection of the different labels associated with a key is performed by selectively energizing the first and the second source.

7 Claims, 2 Drawing Sheets

KEYBOARD WITH MULTIFUNCTION KEYS AND APPARATUS INCLUDING SUCH A KEYBOARD

BACKGROUND OF THE INVENTION

The invention relates to an apparatus including a keyboard with at least one key that allows light to pass through which indicates a label that admits of being modified.

The invention also relates to a keyboard having at least one key that allows light to pass through which indicates a label that admits of being modified.

The invention finally relates to a method of modifying the label indicated on a key of a keyboard, which key allows light to pass through.

Such a keyboard is notably described in the journal "IBM Technical Disclosure Bulletin" vol. 27, No. 11, pp. 6604 and 6605, Apr. 1985. The keyboard described in that document comprises keys formed on the basis of a liquid crystal display unit which is controlled via a specific circuit for displaying the desired character.

Such a keyboard makes it possible to modify the label of each key as desired when one wishes to change font or function. However, the device used, which is based on liquid crystals, is costly and relatively complex.

OBJECTS AND SUMMARY OF THE INVENTION

It is an object of the invention to propose a simpler, inexpensive keyboard particularly well adapted for electronic apparatus intended for the consumer market, notably for portable apparatus which have small-size keyboards and on which various functions are currently assigned to the same key.

Therefore, an apparatus according to the invention and as defined in the opening paragraph is characterized in that the surface of said key is divided into two parts to which two different labels are associated, and in that it comprises selective lighting means for lighting either part.

In a particularly inexpensive embodiment which is also easy to use, said selective lighting means comprise:

- two polarizing filters whose polarization planes are normal and which are associated to said key opposite said parts,
- and two light sources each light source respectively emitting a polarized light in one of said planes, and being selectively lit for lighting said key.

The invention is advantageously used in a telephone terminal, notably a portable telephone terminal. To reduce the size of this type of apparatus, one is in effect led to limit the number of keys of the keyboard and thus regroup various functions under the same key, which complicates the handling of the apparatus. The invention permits of avoiding any combined handling of keys for selecting the sought function and thus considerably facilitates the handling of this type of apparatus for the consumers.

For another embodiment, said keyboard includes a selection key for selecting a mode of operation, said key permitting of controlling the selective lighting of said keyboard.

Thus, all the labels carried by the multifunction keys are modified when a mode of operation is changed.

These and other aspects of the invention will be apparent from and elucidated with reference to the embodiments described hereinafter.

DESCRIPTION OF PREFERRED EMBODIMENTS

Figure 1:
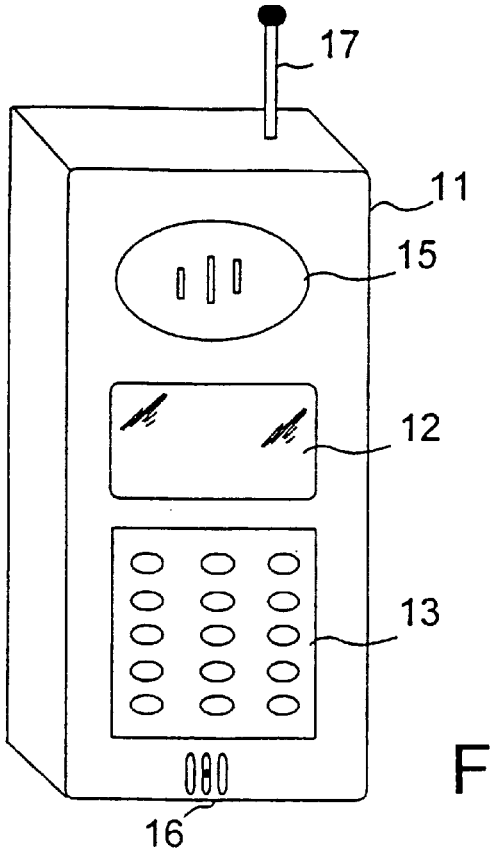
FIG. 1 represents an example of a telephone apparatus according to the invention.

In FIG. 1 is represented a mobile telephone 11 which comprises a screen 12, a keyboard 13 with keys, a loudspeaker/receiver 15, a microphone 16, and an antenna 17.

In the embodiment described here by way of example, the keyboard comprises fifteen keys and the terminal has two modes of operation. The key 20 makes it possible to select a mode of operation of the terminal and to transform the keyboard conforming to the selected mode of operation.

Figure 2:
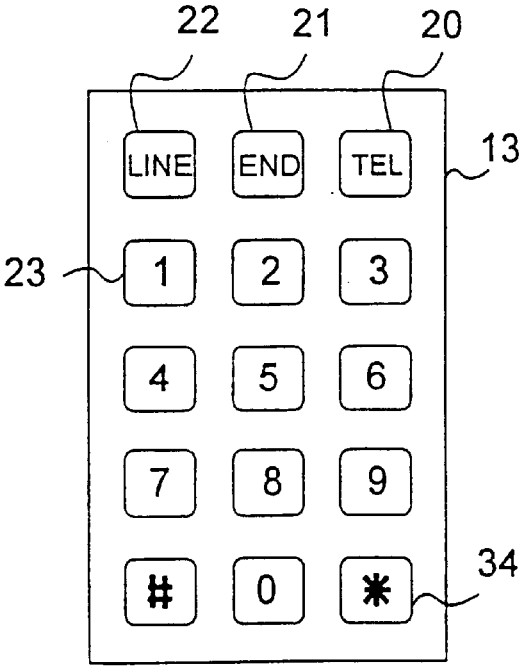
FIG. 2 and 3 represent two different states of an example of a keyboard according to the invention.

The first mode of operation of the terminal is the telephone mode; it provides the conventional telephone functions. The keyboard of the terminal in this mode of operation is represented in FIG. 2. According to FIG. 2, the selection key 20 is labeled "TEL" to indicate that the terminal is in the telephone mode. Two keys 21 and 22 carry the respective labels "LINE" and "END" to indicate the functions of seizing and returning the line. The keys 23 to 34 carry the conventional symbols of a telephone keyboard, that is to say, the digits 0 to 9 and the symbols # and *.

Figure 3:
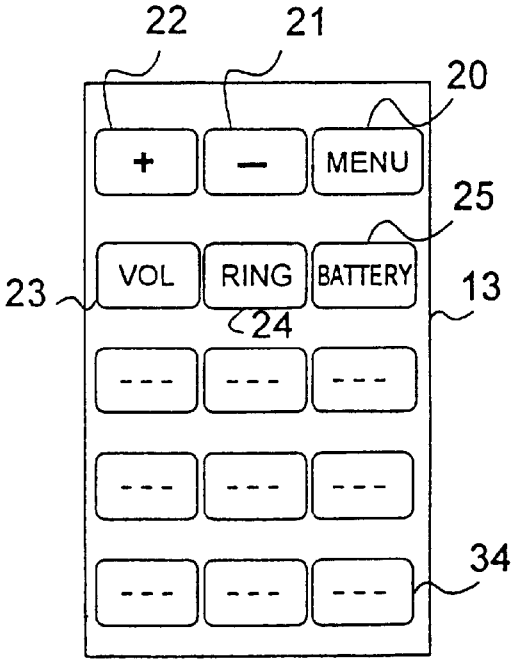

The second mode of operation of the terminal is the menu mode; it permits of configuring the various parameters of the terminal (choice of the type and volume of the ringing sound, for example), of consulting various indicators (state of charge of the batteries, for example), reading messages in the message box . . . The keyboard of the terminal in this mode of operation is represented in FIG. 3. According to FIG. 3, the selection key 20 is then labeled "MENU" to indicate that the terminal is in the menu mode, the keys 21 and 22 carry the respective symbols "+" and "−" to indicate the moving function for moving upwards or downwards in a list, or the function of augmenting or diminishing a value. The keys 23 to 34 carry symbols indicating the various functions available on the telephone. By way of example, the key 23 is labeled "VOL" to indicate the function of volume regulation. The key 24 is labeled "RING" to indicate the function of a ringing option. The key 25 is labeled "BATTERY" to indicate the function of consulting the charging state of the battery . . .

Figure 4:
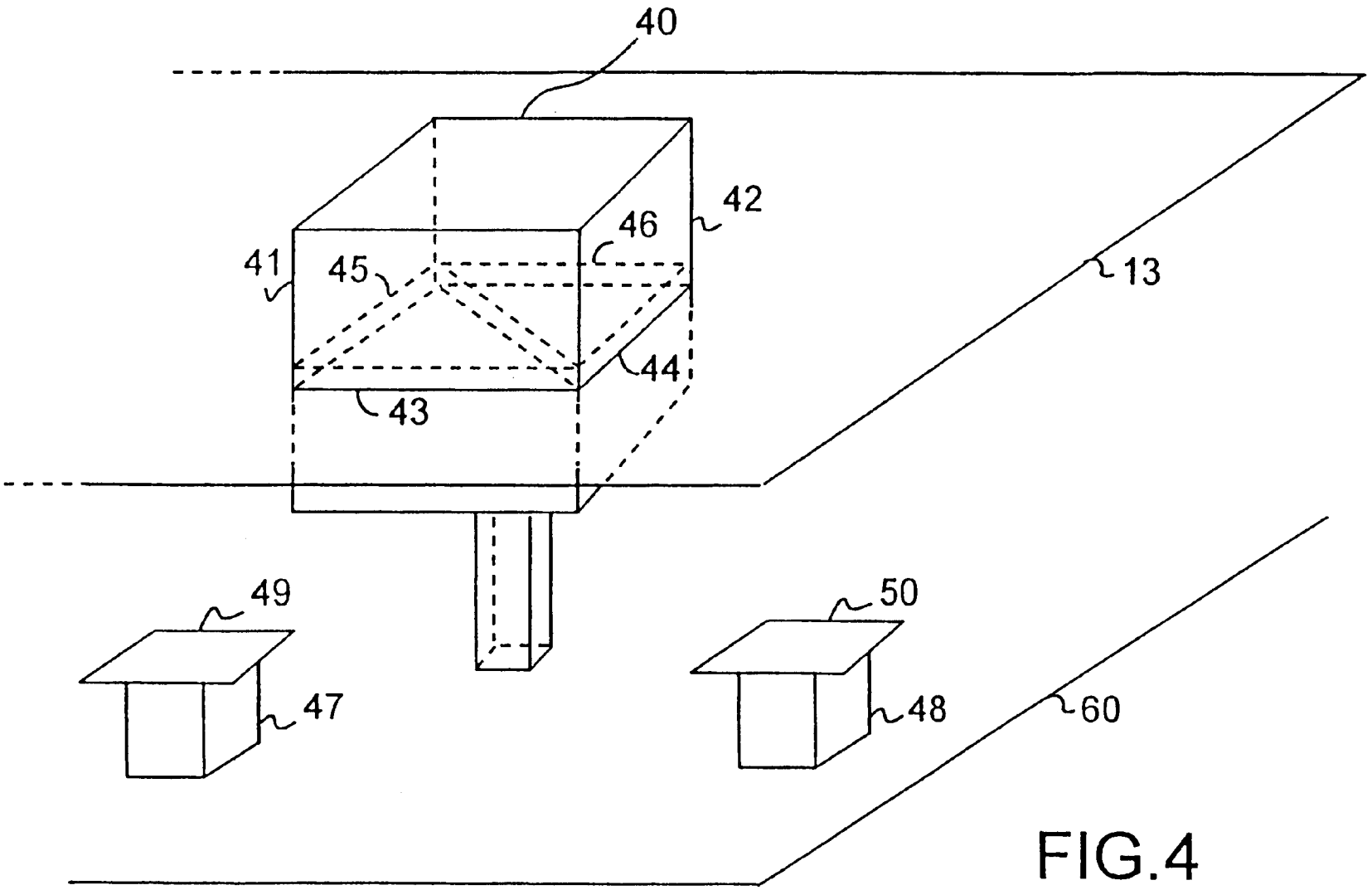
FIG. 4 represents an embodiment of a keyboard according to the invention.

In FIG. 4 is represented in detail a key of the keyboard, whose label admits of being modified, and the selective lighting means of the keyboard.

In accordance with the invention, this key 40 is realized to allow the light to pass and it is divided into two parts 41 and 42 marked off by the diagonal of the square surface of the key. On either one of these parts is stuck a film that carries one of the two labels associated to the key. For example, for key 20 of the telephone of FIG. 1, one of the films is labeled "MENU" and the other film carries the "TEL" label. These films are referenced 43 and 44 in FIG. 4. On top of or underneath these films one has also stuck to polarizing filters 45 and 46 whose polarization planes are normal. The filter 45 is provided for filtering the polarized light in a first direction and emitting the polarized light in a second direction perpendicular to the first direction. In contrast, the filter 46 is provided for filtering the polarized light in said second direction and emitting the polarized light in said first direction.

In accordance with the invention, two polarized light sources are used in perpendicular planes to light the keyboard. In practice, these light sources are formed on the basis of light-emitting diodes on which polarizing films are stuck. In the Figure are represented two light-emitting diodes 47 and 48. On diode 47 is stuck a film 49 to polarize the light in said second direction and on diode 48 is stuck a film 50 to polarize the light in said first direction. Thus, the light emitted by the diode 47 is filtered by the filter 46 and transmitted by the filter 45. In contrast, the light emitted by the diode 48 is filtered by the filter 45 and transmitted by the filter 46.

If one recaptures the example of the key 20 of the telephone of FIG. 1, when the lighting of the diode 47 is controlled by selecting the telephone mode, the "TEL" label shows up on the key. And when the diode 48 is controlled by selecting the menu mode, the "MENU" label shows up on the key.

These diodes are soldered directly onto the printed circuit 60 of the telephone which is located underneath the keyboard. They are spread over the surface of the circuit so as to be able to light the whole keyboard.

A keyboard according to the invention includes one or various keys of the type which has just been described. When the fifteen keys of the telephone represented in FIG. 1 are of this type, four light-emitting diodes will suffice to light the whole keyboard (two diodes for permitting the polarized light in said first direction, and two other diodes for emitting a polarized light in said second direction.

It will be obvious that modifications may be made in the embodiment which has just been described, notably by substituting equivalent technical means, without one leaving the scope of the present invention. More particularly, the invention in essence consists of varying the lighting of the keyboard before one or the other of the two labels associated to a key is displayed. The embodiment of this concept is admitting of variation.

Moreover, although the invention has been described for a telephone, it is applicable to any other type of apparatus including a keyboard. For example, it is applicable to calculators, electronic diaries, measuring apparatus (oscilloscopes, multimeters . . . ).

The keyboard according to the invention may comprise any number of keys, all of them or part of them admitting of indicating various labels, as has been described above. It is also possible that certain keys are only lit from the back, and the form of these keys may certainly be any form.

I claim:

1. An apparatus comprising:

a keyboard with at least one key capable of selectively passing through light to an observer from a first light source and a second light source, said first and second light sources being mounted at a side of the keyboard opposite to the observer, wherein said first light source is constructed so as to emit first plane-polarized light polarized in a first plane, and said second light source is constructed so as to emit second plane-polarized light polarized in a second plane, the second plane being perpendicular to the first plane, and wherein said key comprises:

a first part provided with a first label, said first label being selectively observable by the observer, and a first polarizing filter, said first polarizing filter being associated with said first part and being capable of passing through the first plane-polarized light and filtering the second plane-polarized light; and a second part provided with a second label, said second label being selectively observable by the observer, and a second polarizing filter, said second polarizing filter being associated with said second part and being capable of passing through the second plane-polarized light and filtering the first plane-polarized light; and the keyboard further comprises selection means for selectively energizing said first and second light sources.

2. An apparatus as claimed in claim 1, wherein said first and second light sources are capable of illuminating said keyboard at said side of said keyboard opposite to the observer, and said keyboard comprises a set of keys capable of selectively passing through light, and a selection key for selecting a first mode of operation in which a first set of labels associated with said set of keys is selected, and a second mode of operation in which a second set of labels associated with said set of keys is selected.

3. An apparatus as claimed in claim 1, wherein said apparatus is a telephone terminal.

4. A keyboard comprising:

at least one key capable of selectively passing through light to an observer from a first light source and a second light source, said first and second light sources being mounted at a side of the keyboard opposite to the observer, wherein said first light source is constructed so as to emit first plane-polarized light polarized in a first plane, and said second light source is constructed so as to emit second plane-polarized light polarized in a second plane, the second plane being perpendicular to the first plane, and wherein said key comprises:

a first part provided with a first label, said first label being selectively observable by the observer, and a first polarizing filter, said first polarizing filter being associated with said first part and being capable of passing through the first plane-polarized light and filtering the second plane-polarized light; and a second part provided with a second label, said second label being selectively observable by the observer, and a second polarizing filter, said second polarizing filter being associated with said second part and being capable of passing through the second plane-polarized light and filtering the first plane-polarized light; and the keyboard further comprises selection means for selectively energizing said first and second light sources.

5. A keyboard as claimed in claim 4, wherein said first and second light sources are capable of illuminating said keyboard at said side of said keyboard opposite to the observer, and said keyboard comprises a set of keys capable of selectively passing through light, and a selection key for selecting a first mode of operation in which a first set of labels associated with said set of keys is selected, and a second mode of operation in which a second set of labels associated with said set of keys is selected.

6. A keyboard as claimed in claim 4, wherein the first and second filters are mounted at sides of the first and second labels opposite to the observer.

7. A keyboard as claimed in claim 4, wherein the first and second filters are mounted at sides of the first and second labels facing the observer.

* * * * *